United States Patent [19]

Thompson

[11] Patent Number: 4,916,864

[45] Date of Patent: Apr. 17, 1990

[54] SNAP-IN GASKET SYSTEM FOR REFRIGERATOR AND FREEZER DOORS

[75] Inventor: Thomas R. Thompson, Anderson, S.C.

[73] Assignee: White Consolidated Industries, Inc., Cleveland, Ohio

[21] Appl. No.: 347,680

[22] Filed: May 5, 1989

[51] Int. Cl.[4] ..... E06B 7/16

[52] U.S. Cl. ..... 49/478; 49/493

[58] Field of Search ..... 49/478, 485, 493

[56] References Cited

U.S. PATENT DOCUMENTS

| | | | |
|---|---|---|---|
| 2,958,912 | 11/1960 | Bower et al. | 49/478 |
| 3,242,537 | 3/1966 | Monti | 49/478 X |
| 3,323,256 | 6/1967 | Reahard et al. | 49/478 |
| 3,359,053 | 12/1967 | Hagendoorn | 49/478 X |
| 3,400,964 | 9/1968 | Baermann | 49/478 X |
| 3,411,243 | 11/1968 | Baermann | 49/478 |
| 4,469,383 | 9/1984 | Losert | 49/478 X |
| 4,644,698 | 2/1987 | Gerdes et al. | 49/478 |
| 4,653,819 | 3/1987 | Swerbinsky | 49/478 X |

*Primary Examiner*—Philip C. Kannan

*Attorney, Agent, or Firm*—Pearne, Gordon, McCoy & Granger

[57] ABSTRACT

A gasket assembly for refrigerator or freezer doors includes a retainer and a flexible gasket. The retainer is mounted along the periphery of the door by screws which extend through the retainer, through the periphery of a door liner and into the door shell. Therefore, the mounting of the retainer also mounts the liner on the door. The retainer cooperates with the door to provide an outwardly open channel and provides an oppositely extending shoulder. The retainer is mounted on the door prior to the installation of the gasket, so full access is provided, permitting automated assembly. After the retainer is mounted, the gasket is installed by positioning an inwardly extending projection within the outwardly open channel and snapping a hooklike projection over the shoulder extending along the inside of the retainer. The gasket provides a magnetic cavity containing a strip magnet and supported by flexible walls. A flap along the interior of the gasket engages the liner.

13 Claims, 3 Drawing Sheets

SNAP-IN GASKET SYSTEM FOR REFRIGERATOR AND FREEZER DOORS

BACKGROUND OF THE INVENTION

This invention relates generally to door gaskets, and more particularly to a novel and improved gasket system for the doors of refrigerators, freezers, and the like.

Prior Art

In many instances, a refrigerator or freezer door provides a metallic shell and a plastic liner with insulation between them. Generally, a magnetic gasket is mounted along the periphery of the door. The magnetic material in the gasket presses the gasket against the adjacent cabinet to establish a seal between the door and cabinet.

In some instances, the gasket provides a mounting portion which is clamped between the door shell and liner. In other instances, a retainer strip is mounted on the door to hold the gasket in place. Further, in many prior systems, one portion of the gasket is positioned in a mounting location and the gasket is bent back from its normal mounted position while fasteners are inserted and tightened. Examples of such later gasket systems are illustrated in U.S. Pat. Nos. 3,359,053 and 4,469,383. In other instances, the door is structured to provide a retainer channel or the like and the seal or gasket is snapped into the channel when the gasket is installed. Examples of such systems are illustrated in U.S. Pat. Nos. 3,289,352; 3,353,321; 3,378,957; 3,403,477; 3,869,873; and 4,305,230.

In some instances, a retainer is provided through which fasteners extend to connect the liner and the door shell, as well as provide a mounting for the gasket. Examples of such systems are illustrated in U.S. Pat. Nos. 3,242,537; 4,469,383; and 4,644,698. In systems in which the gasket must be held back or distorted to provide access to the fasteners during installation, difficulty is encountered if automated assembly is required, Without automated assembly, such systems are highly labor-intensive, and therefore expensive. Also, such systems can result in improperly installed gaskets.

SUMMARY OF THE INVENTION

The present invention provides a novel and improved gasket system which is particularly suited for automated assembly and which combines low-cost, reliable assembly and reliable operation.

The system includes a simple retainer strip which is mounted along the edge of the non-metallic door liner. Screws threaded through the retainer extend through the liner and into the door shell. Therefore, the screws mount the liner on the door, and also mount the retainer.

The retainer is formed with a main channel in which the screws are inserted. The heads of the screws are recessed in the channel and do not contact the subsequently installed gasket nor interfere with its installation or function in any way.

The retainer is provided with a first shoulder at its outer edge which cooperates with adjacent surfaces of the door shell to define an outwardly open channel. The inner edge of the retainer is formed with a second shoulder extending in the direction opposite the first shoulder.

The gasket itself is extruded from an elastomeric type material and provides a base which, when the gasket is installed, extends along the forward extremity of the retainer. An outer inturned projection is sized and positioned for insertion into the outwardly open channel between the first shoulder and the door. This projection is shaped and sized to tightly fit into the channel and form a good seal with both the door shell and the retainer. The inner edge of the base portion is provided with a hooklike projection which hooks over the second shoulder along the inner side of the retainer to complete the snap-on mounting of the gasket on the retainer. At the inner extremity of the gasket, a flap is provided which extends into engagement with the liner. When installed, the retainer and the junction between the liner and the shell are completely obscured from view, and good sealing contact is provided with the shell and liner.

Forwardly from the base portion is a longitudinal cavity in which magnetic material is positioned. Such cavity is connected to the outer edge of the base by a generally S-shaped flexible wall and with the inner edge of the base by a relatively long curved flexible wall portion. The gasket, therefore, defines a longitudinally extending chamber between the base and magnetic cavity portions thereof. The inner flap, in combination with the door liner, also defines a separate chamber to reduce the existence of a heat-conductive flow path past the seal.

Also, a gasket is provided with an upstanding stub wall which is engageable with the inner edge of the magnetic channel to prevent the channel from tipping or rolling when the door is closed.

With this illustrated embodiment, an improved gasket system is provided in which assembly can be easily automated to eliminate high labor costs, and which is reliably assembled to provide a durable and reliable seal.

These and other aspects of this invention are illustrated in the accompanying drawings, and are more fully described in the following specification.

DETAILED DESCRIPTION OF THE DRAWINGS

Figure 1:
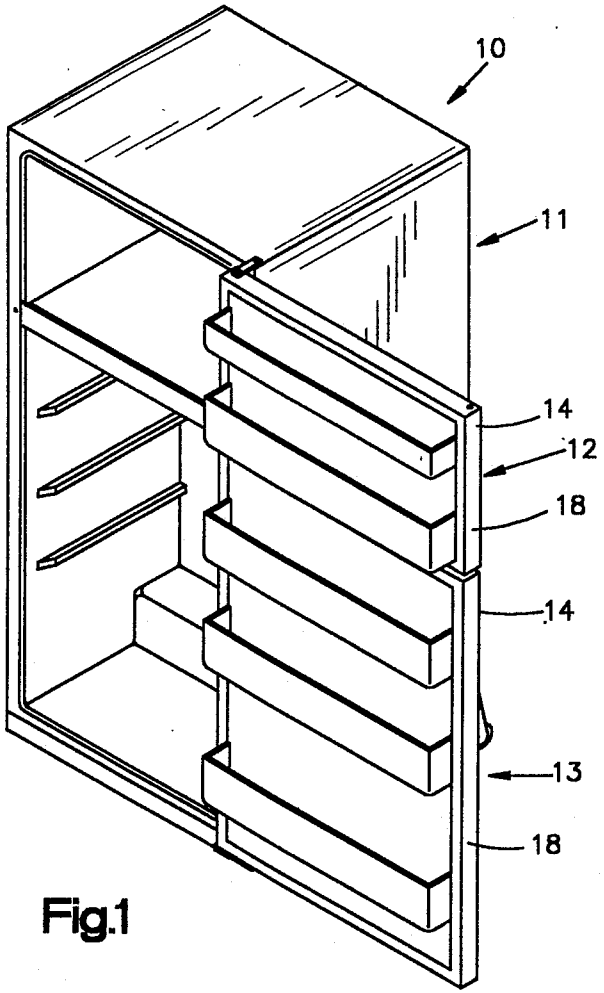
FIG. 1 schematically illustrates a typical refrigerator incorporating this invention.

FIG. 1 illustrates a typical refrigerator 10 incorporating the present invention. Such refrigerator includes a main cabinet 11 and upper and lower doors 12 and 13, respectively, mounted thereon by hinges so that the doors can be opened and closed to provide access to the interior of the refrigerator.

Each of the doors includes an outer sheet metal shell 14 and a molded plastic liner 16. The liners are typically provided with shelves and compartments permitting the storage of foodstuffs on the doors themselves.

In the illustrated embodiment, the shell is insulated by foamed-in-place insulation 15 prior to the installation of the liner.

The two doors 12 and 13 are normally provided with identical sealing gasket assemblies, so only one will be discussed in detail, with the understanding that it applies equally to the other door.

Figure 2:
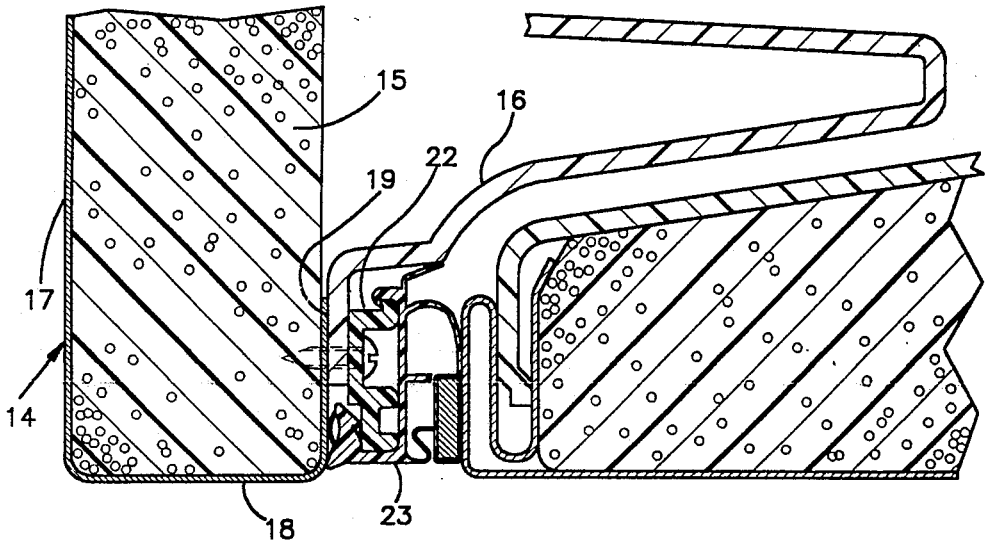
FIG. 2 illustrates, in cross section, the structure of an assembled gasket system in a typical installation on the door of a refrigerator or freezer.

The sheet metal shell 14 provides a rectangular, planar front face 17 and lateral side portions 18 extending from the front face to inturned flanges 19. These inturned flanges 19 provide a border around the shell along which the liner 16 is mounted. Such liner provides a peripheral flange 21 which overlays the inturned flange 19 of the shell, as best illustrated in FIG. 2.

The seal provided on the door includes an extruded retainer strip 22 and a snap-on, flexible gasket 23. The retainer, which is relatively rigid plastic such as an ABS plastic, serves the dual function of securing the liner to the shell and also providing the mounting of the flexible gasket 23.

The retainer is provided with a groove 24 which extends along the edge of the liner 16. Threaded fasteners 26 extend from the groove 24 through the base of the retainer and through the flange 21 of the liner into the inturned flange 19 of the shell. Therefore, these screws mount the liner and the retainer on the shell. The groove 24 is sized so that the heads 27 are spaced back from the forward extremities 28 of the retainer. In the assembled seal, the screw and the screw head do not in any way affect the operation of the flexible seal 23.

Figure 4:
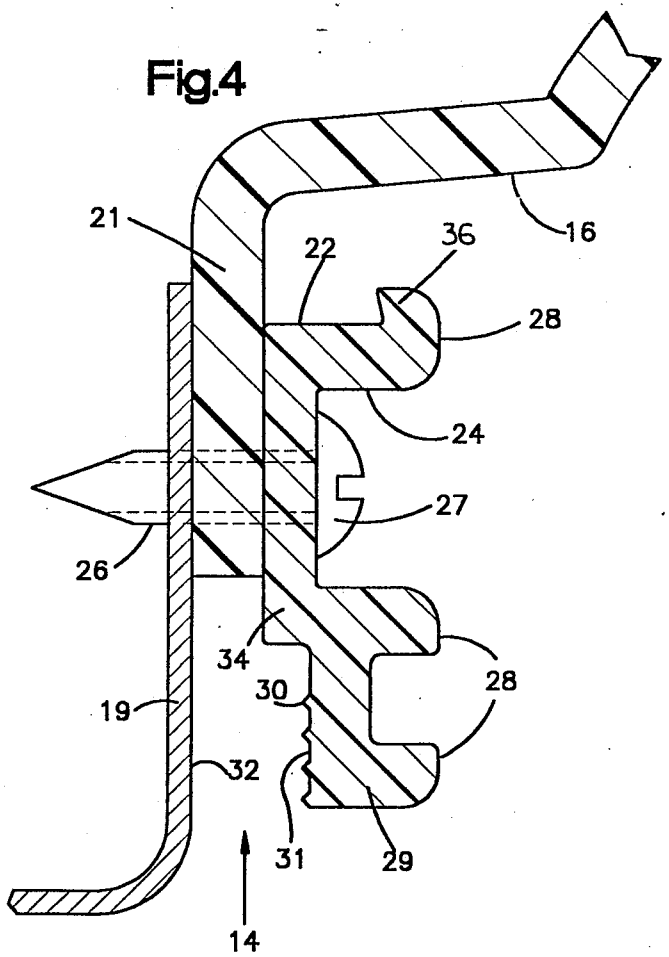
FIG. 4 is an enlarged cross section of the retainer after it has been installed on the door and prior to the installation of the gasket.

As best illustrated in FIG. 4, the retainer is installed on the door prior to the installation of the flexible gasket. Consequently, full access is provided for the insertion of the screws 26, and the assembly of the shell, the liner, and the retainer can be conveniently automated for reduced cost.

The retainer is provided with an outwardly extending shoulder portion 29 providing an inner wall 31 spaced from the adjacent surface 32 of the shell 14. The surface of the wall 31 cooperates with the surface 32 to define an outwardly open channel 33. The shouder portion 29 is offset forwardly from the base wall 34 so that the inner wall surface 31 is spaced from the outer surface 32 by a distance greater than the thickness of the liner 16. Further, the wall is provided with ribs 30 to assist in locking the gasket in position.

An inwardly directed shoulder 36 is formed along the inner extremity of the retainer 22 which cooperates with the outwardly extending channel 33 to provide a mounting structure for the flexible gasket 23. In the illustrated embodiment, the retainer is provided with a second groove 37 to reduce the material requirements for the manufacture of the retainer, and also to provide a retainer structure having a substantially uniform wall thickness.

Figure 3:
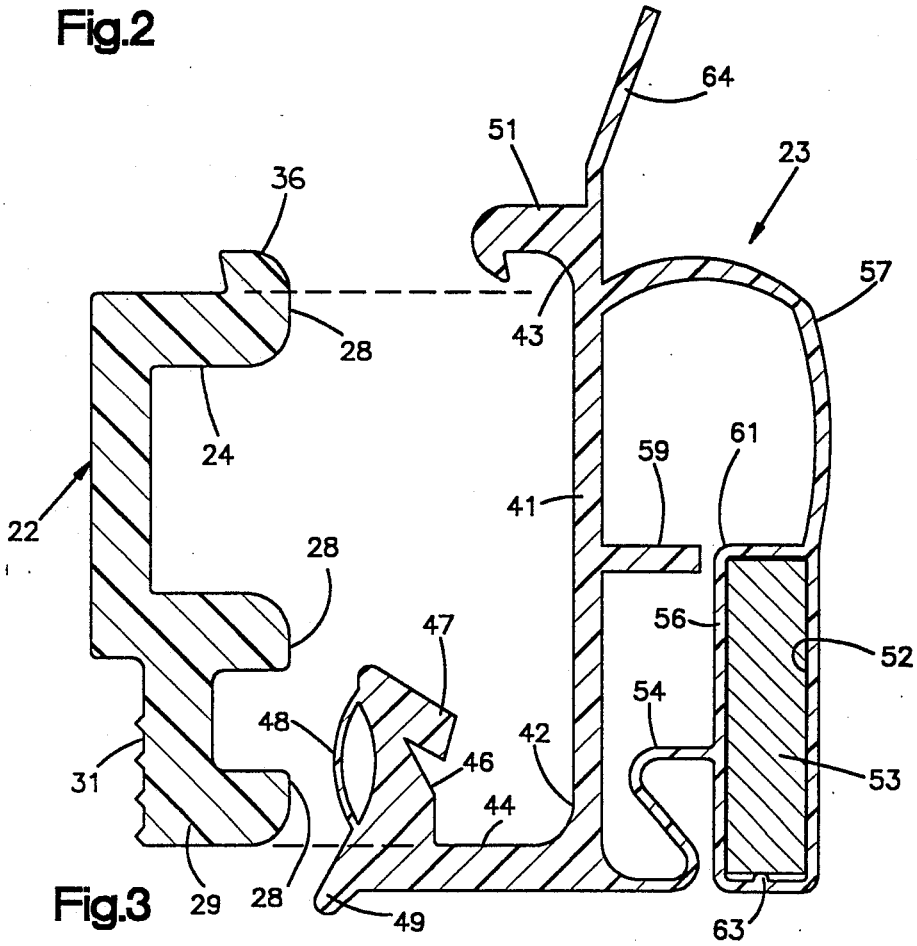
FIG. 3 is an enlarged cross section of the retainer and gasket components before installation.

The flexible gasket 23 has an unstressed shape, best illustrated in FIG. 3. Such gasket is also preferably extruded, but in the instance of the gasket itself, it is formed of a relatively soft, flexible material, such as vinyl. The gasket provides a base wall 41 extending from an outer end at 42 to an inner end at 43. A lateral wall portion 44 extends rearwardly from the outer end 42 and is provided with an inwardly extending mounting projection 46 at its inner end. This projection includes a hooked portion 47 extending back along the projection 46 and inclined relative thereto. The projection 46 also provides a relatively thin, convex curved wall portion 48. An outwardly and rearwardly extending lip 49 is formed at the end of the wall portion 44 on the opposite side thereof from the mounting projection 46. The inner end 43 of the base wall 41 is provided with a lateral, hook-shaped mounting projection 51 which cooperates with the mounting projection 46 to secure the flexible gasket to the retainer 22 in an assembled gasket system.

The gasket also provides a longitudinally extending, rectangular cavity 52 which encloses a strip of flexible magnetic material 53. This magnetic strip 53 extends lengthwise of the gasket and is supported by the base wall 41 at a location forwardly spaced therefrom. A part of the support for the magnetic strip is provided by a thin, S-shaped wall 54 which extends from the outer end 42 of the base wall 41 and is joined to the wall portion 56 defining the cavity 52 at a location spaced back from the outer end thereof.

A relatively long, relatively thin, convexly curved wall 57 also provides support for the portion of the gasket containing the magnetic strip. This curved wall 57 extends from adjacent to the inner end 43 of the base wall 41 and joins with the wall portion 56 defining the cavity 52 at its forward but inner end at 58. With this structure, the magnetic strip is supported from the ends of the base wall and is free to move a limited amount relative to the base wall, due to the flexibility of the wall portions 54 and 57.

In order to resist rolling or twisting of the magnetic strip when the door is opened and closed, an outwardly extending stub wall 59 extends from the base wall 41 to a location adjacent to the inner corner 61 of the cavity 52 enclosing the magnetic strip 53.

In order to allow the insertion of the magnetic strip into the cavity 52, the strip 53 and cavity 52 are sized to provide a somewhat loose fit. However, a rib 63 is provided and is sized to be deflected a small amount so that a frictional contact is provided with the installed magnetic strip to hold it in position. The gasket is also provided with an inwardly extending skirt 64 which engages the adjacent portion of the liner when the gasket is fully installed.

Figure 6:
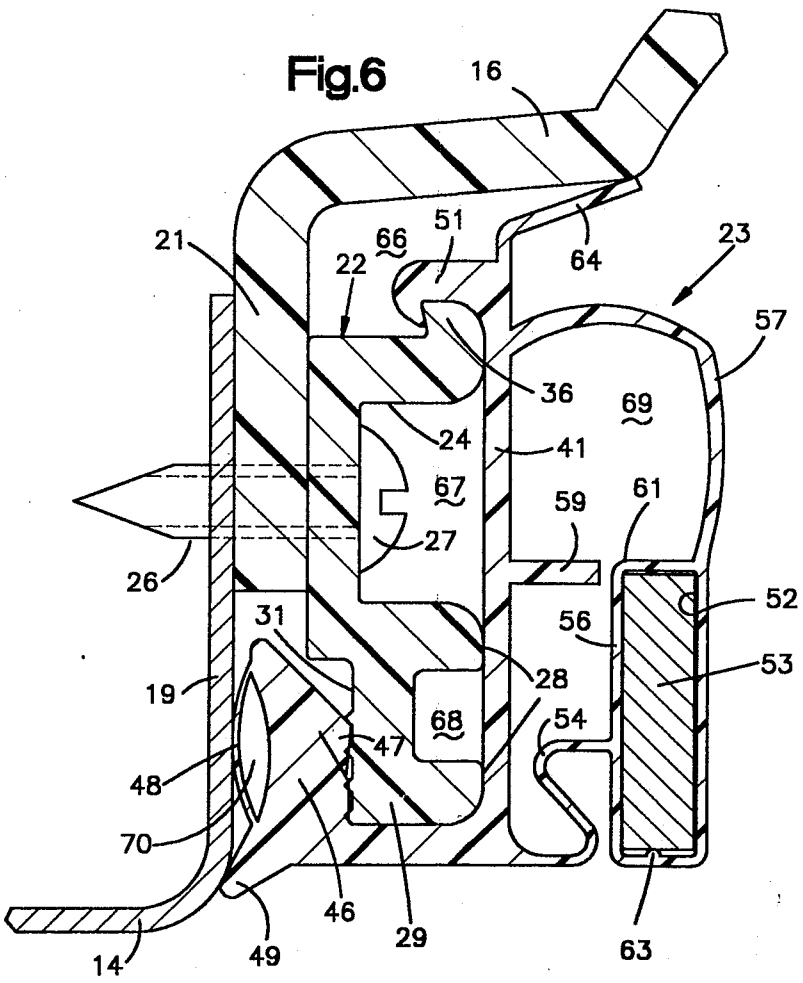
FIG. 6 is an enlarged view similar to FIGS. 4 and 5 illustrating the installed gasket assembly.
Figure 5:
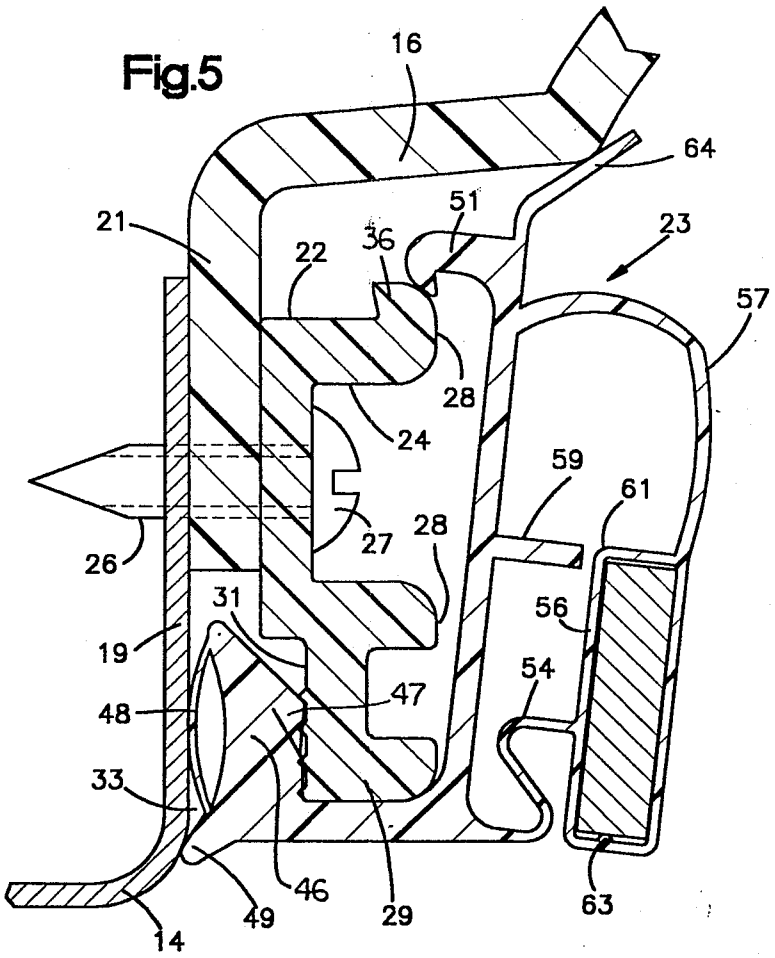
FIG. 5 is a view similar to FIG. 4, but illustrating the gasket in an intermediate point in its installation.

The manner in which the gasket is mounted on the retainer is best illustrated in FIGS. 5 and 6. The mounting projection 46 is first pressed into the outwardly open channel 33. The various components are sized so that when the mounting projection is inserted into the channel, the hook 47 is deflected rearwardly so as to ensure a tight sealing engagement with the inner wall 31 of the retainer. Further, to ensure a firm gripping or mounting of the gasket, such inner wall is provided with a plurality of sawtooth-like ribs 30 which interlock with the hook-shaped portion to resist outward movement thereof. The lip 49 is also sized so that it is displaced from its unstressed position by engagement with the adjacent wall of the shell 14. Further, the wall portion 48 is deflected from its unstressed condition a small amount. Once the mounting projection 46 is inserted into the outwardly open channel 33, a reliable seal is provided between the gasket and the shell 14 along the outer edge of the gasket.

The insertion of the mounting projection 46 into the channel results in inward movement of the gasket to the position illustrated in FIG. 5, in which the hook-shaped mounting projection is substantially adjacent to the inner shoulder 36. The mounting of the gasket is then completed by merely pressing the inner edge of the gasket until the mounting projection 51 latches onto the inner shoulder 36, as best illustrated in FIG. 6.

When the gasket is fully installed, the skirt 64 presses against the adjacent surface of the liner to provide a neat joint between the gasket and the liner. Further, the installed gasket completely encloses the retainer and also the peripheral edge of the liner, creating a neat transition therebetween. The gasket functions efficiently to resist heat flow, since it defines a plurality of lengthwise extending and separated cavities 66 through 70. These cavities cooperate to resist the passage of heat past the gasket and provide a very effective thermal seal between the door and the cabinet. When the door is closed, of course, the magnetic strip clamps the adjacent portion of the gasket into tight sealing engagement with the adjacent metal part of the main cabinet 11.

With this invention, an effective gasket is easily installed and functions in a reliable manner to provide the required seal between the door and the cabinet. Because the screws are fully accessible during assembly of the retainer and liner, automated assembly equipment can be effectively utilized. Further, the installation of the gasket, which in effect snaps into position, can also be automated without difficulty. Consequently, the labor content of the manufacture is minimized.

Although the preferred embodiment of this invention has been shown and described, it should be understood that various modifications and rearrangements of the parts may be resorted to without departing from the scope of the invention as disclosed and claimed herein.

What is claimed is:

1. A magnetic gasket assembly for establishing a seal between the cabinet and door of a refrigeration appliance, comprising a retainer having inner and outer edges, said retainer being adapted to be mounted along the periphery of a door and providing along said outer edge thereof a lateral first shoulder positioned opposite to and spaced from an adjacent door surface when said retainer is installed and cooperating therewith to define an outwardly open channel, said inner edge of said retainer providing a second shoulder substantially extending in a direction opposite from said first shoulder, the gasket providing a base having inner and outer ends mountable on said retainer after said retainer is mounted, said gasket providing an inturned flange projection at said outer end of said base sized to fit said channel and secure said outer edge and to provide a seal with a door and the outer edge of said retainer, said inturned flange providing an outwardly extending hook portion diverging from the adjacent portions of said inturned flange when in its unstressed condition, said outwardly extending hook portion being deformed from its unstressed condition into engagement with said adjacent portions of said inturned flange by engagement with said first shoulder when said inturned flange is positioned in said channel to produce a tight seal with said retainer, said gasket also providing an inturned hook portion sized to hook onto said second shoulder to secure said inner side of said gasket on said retainer.

2. A magnetic gasket assembly as set forth in claim 1, wherein said first shoulder provides ribs engageable with said outwardly extending hook portion when said inturned flange is positioned in said channel to cooperate with said outwardly extending hook portion to secure said inturned flange in said channel.

3. A magnetic gasket assembly as set forth in claim 2, wherein said gasket includes wall surfaces defining a longitudinal cavity having inner and outer edges and containing magnetic material, flexible walls extending between said base and said wall surfaces defining said cavity supporting said wall surfaces defining said cavity at a location spaced from said base and permitting movement of said wall surfaces defining said cavity toward and away from said base.

4. A magnetic gasket assembly as set forth in claim 3, wherein one of said flexible walls is generally S-shaped and extends between the outer end of said base and said wall surfaces defining said cavity intermediate said inner and outer edges of said cavity.

5. A magnetic gasket assembly as set forth in claim 4, wherein the other of said flexible walls extends between said inner end of said base and said inner edge of said cavity.

6. A magnetic gasket assembly as set forth in claim 5, wherein a stub wall extends from said base toward said wall surfaces defining said cavity, said stub wall being engageable with walls defining said cavity to resist twisting of said cavity relative to said base.

7. A magnetic gasket assembly as set forth in claim 5, wherein said flexible walls cooperate with said base and cavity to define a first longitudinal chamber.

8. A magnetic gasket assembly as set forth in claim 7, wherein a stub wall extends from said base toward said cavity within said chamber, said stub wall being engageable with said wall surfaces defining said cavity to resist twisting of said cavity relative to said base.

9. A magnetic gasket assembly as set forth in claim 7, wherein said door includes a shell and a liner secured to said shell by said retainer, said gasket also provides an inwardly extending skirt engageable with said liner at a location inwardly spaced from said retainer, said flap operating to define a portion of a second longitudinal chamber isolated from said first longitudinal chamber.

10. A magnetic gasket assembly as set forth in claim 1, wherein said inturned flange projection includes a flexible convex wall portion deflected from its unstressed position by engagement with said door when said gasket is installed on said retainer.

11. An insulated refrigerator door comprising a shell having a periphery, a liner mounted along said periphery of said shell, a retainer having inner and outer edges mounted along said periphery on the side of said liner opposite said shell, said retainer providing a longitudinal channel, fasteners in said channel extending through said retainer and liner into said shell securing them together, said retainer providing an outer shoulder along said outer edge spaced from and substantially parallel to the adjacent surface of said shell and cooperating therewith to define an outwardly open channel, an inner shoulder along said inner edge of said retainer, a gasket providing a base having inner and outer edges mounted on said retainer, said gasket providing an inturned flange projection at said outer edge of said base fitting tightly into said outwardly open channel securing said gasket on said door along the outer edge thereof, and providing a seal with said retainer and said shell, said gasket also providing an inturned hook portion sized to hook over said inner shoulder to secure the inner side of said gasket on said retainer, said gasket providing wall surfaces defining a longitudinal cavity having inner and outer edges supported by said base at a location spaced from said base by flexible walls permitting movement of said cavity toward and away from said base, magnetic material in said cavity operable to clamp said cavity into engagement with an adjacent metal surface, said gasket providing an inwardly extending skirt engageable with said liner at a location inwardly spaced from said retainer, said flange projection providing a reverse hook-shaped extension, and said outer shoulder providing ribs engageable with said hook-shaped extension to secure said flange projection in said outwardly open channel.

12. A refrigerator door as set forth in claim 11, wherein said gasket provides a stub wall extending from said base engageable with said walls defining said walls defining said cavity to resist twisting thereof.

13. A refrigerator door as set forth in claim 12, wherein said retainer provides a forwardly open channel, a screw recessed within said channel securing said retainer and liner to said shell.

* * * * *